US008397666B2

(12) United States Patent
Delap

(10) Patent No.: US 8,397,666 B2
(45) Date of Patent: Mar. 19, 2013

(54) MANDREL COATING ASSEMBLY

(75) Inventor: Dennis J. Delap, Bloomington, IN (US)

(73) Assignee: Cook Medical Technologies LLC, Bloomington, IN (US)

( * ) Notice: Subject to any disclaimer, the term of this patent is extended or adjusted under 35 U.S.C. 154(b) by 1025 days.

(21) Appl. No.: 12/328,499

(22) Filed: Dec. 4, 2008

(65) Prior Publication Data

US 2009/0148590 A1 Jun. 11, 2009

Related U.S. Application Data

(60) Provisional application No. 60/992,926, filed on Dec. 6, 2007.

(51) Int. Cl.
*B05C 13/02* (2006.01)
*B05B 13/02* (2006.01)

(52) U.S. Cl. ..... 118/500; 118/320; 118/501; 118/502

(58) Field of Classification Search ..... 118/320, 118/500
See application file for complete search history.

(56) References Cited

U.S. PATENT DOCUMENTS

| | | | | |
|---|---|---|---|---|
| 4,739,762 | A | 4/1988 | Palmaz | 128/343 |
| 4,909,979 | A * | 3/1990 | Possis et al. | 264/571 |
| 5,133,732 | A | 7/1992 | Wiktor | 606/195 |
| 5,292,331 | A | 3/1994 | Boneau | 606/198 |
| 5,421,955 | A | 6/1995 | Lau et al. | 216/48 |
| 6,090,127 | A | 7/2000 | Globerman | 606/194 |
| 6,517,889 | B1 | 2/2003 | Jayaraman | 427/2.24 |
| 6,565,659 | B1 | 5/2003 | Pacetti et al. | 118/500 |
| 6,572,644 | B1 | 6/2003 | Moein | 623/1.11 |
| 6,818,063 | B1 | 11/2004 | Kerrigan | 118/500 |
| 6,955,723 | B2 | 10/2005 | Pacetti et al. | 118/500 |
| 6,972,054 | B2 * | 12/2005 | Kerrigan | 118/500 |
| 7,060,319 | B2 * | 6/2006 | Fredrickson | 427/2.24 |
| 7,094,765 | B1 | 8/2006 | Iversen et al. | 514/44 |
| 7,306,677 | B2 | 12/2007 | Robida | 118/503 |
| 7,354,480 | B1 | 4/2008 | Kokish et al. | 118/500 |
| 7,402,329 | B2 | 7/2008 | Pacetti et al. | 427/2.1 |
| 2004/0013792 | A1 | 1/2004 | Epstein et al. | 427/2.24 |
| 2005/0069630 | A1 | 3/2005 | Fox et al. | 427/2.24 |
| 2006/0035012 | A1 | 2/2006 | Pacetti et al. | 427/2.1 |
| 2006/0269587 | A1 | 11/2006 | Iversen et al. | 424/426 |
| 2006/0284383 | A1 | 12/2006 | Brettell | 279/2.1 |
| 2006/0286287 | A1 | 12/2006 | Hossainy | 427/2.1 |
| 2007/0031611 | A1 | 2/2007 | Babaev | 427/600 |
| 2007/0048433 | A1 | 3/2007 | Hallett et al. | 427/2.1 |
| 2007/0048452 | A1 | 3/2007 | Feng et al. | 427/458 |
| 2008/0124452 | A1 | 5/2008 | Kokish et al. | 427/2.25 |

FOREIGN PATENT DOCUMENTS

WO WO 03/006180 A1 1/2003

* cited by examiner

*Primary Examiner* — Dah-Wei Yuan
*Assistant Examiner* — Stephen Kitt
(74) *Attorney, Agent, or Firm* — Brinks Hofer Gilson and Lione

(57) ABSTRACT

Mandrel coating assemblies are provided, as well as methods for coating endoluminal medical devices with a therapeutic agent using the mandrel coating assembly. The endoluminal medical device may be a stent, valve or other medical device, and may include a plurality of interconnected members defining a lumen and plurality of openings positioned along the abluminal surface in communication with the lumen. The mandrel coating assembly may be configured to minimize the coating penetration on the luminal surface of the medical device and/or incidence of webbing or agglomerations of the coating within the openings between the struts.

20 Claims, 8 Drawing Sheets

MANDREL COATING ASSEMBLY

CROSS-REFERENCE TO RELATED APPLICATIONS

The present application claims the benefit of the filing date under 35 U.S.C. §119(e) of U.S. Provisional Application No. 60/992,926, filed Dec. 6, 2007, which is hereby incorporated by reference.

TECHNICAL FIELD

The present invention relates to a device and method for coating medical devices, such as open-celled endovascular stents. Particularly, the present invention relates to mandrel assembly structures useful in performing said coating methods.

BACKGROUND

Medical devices may be coated to provide localized delivery of therapeutic agents to target locations within the body. The therapeutic agents generally may treat localized disease (e.g., heart disease) or occluded body lumens or may mitigate undesirably side effects or costs of systemic drug administration. Localized drug delivery may be achieved, for example, by coating endoluminal devices such as balloon catheters, stents and the like with the therapeutic agent to be locally delivered.

Endoluminal devices may be configured to bring the coating into therapeutically effective contact with the wall of a body vessel. For instance the endoluminal devices may be a radially expandable tubular stent formed by a plurality of interconnected members defining open cells extending between an external (abluminal) surface and an internal (luminal) surface. The therapeutic agent may be applied to the abluminal surface of the endoluminal device for delivery to a treatment site within a body vessel. The luminal surface defines a tubular lumen extending axially from the proximal end to the distal end of the endoluminal device.

When a coating containing the therapeutic agent is applied to the abluminal surface of the endoluminal device, it is desired to provide a uniform coating in order to minimize the coating of the luminal surface. In addition, the therapeutic agent is preferably localized on the interconnected members (e.g., struts and bends) of the endoluminal device, rather than being present within the open cells between these members. Upon radial expansion of the endoluminal device, the distance between adjacent members typically increases and the area enclosed by the open cells between these members typically increases. As such, therapeutic agent coated over, or bridging, such open cells may fall through the cells, into the lumen and be undesirably washed away by the blood from the point of treatment without contacting the wall of the body vessel.

Such coated device structures are commonly deployed within a body vessel to maintain patency of a stenosis, and the therapeutic agent may be selected to mitigate or prevent restenosis of the body vessel after dilation. For example, the endoluminal device may be delivered endovascularly using a catheter delivery system by expanding the endoluminal device from a radially compressed delivery configuration within a portion of the catheter to a radially expanded configuration within the body vessel. The endoluminal device delivery may be performed as part of a procedure to dilate a blood vessel with the catheter balloon, such as percutaneous transcoronary angioplasty (PCTA). The endoluminal device may be radially expanded by a balloon attached to the catheter or may be formed of a material that radially self-expands when released from the catheter.

Coatings have been applied to medical devices by processes such as dipping, spraying, vapor deposition, plasma polymerization, and electrodeposition. Although these processes have been used to produce satisfactory coatings, they have numerous, associated potential drawbacks. For example, it may be difficult to achieve coatings of uniform thicknesses, both on individual parts and on batches of parts. Also, these coating processes may require that the coated part be held during coating, which may result in defects such as bare spots where the part was held and which may thus require subsequent coating steps. Further, many conventional processes require multiple coating steps or stages for the application of a second coating material, or to allow for drying between coating steps or after the final coating step.

One method of coating endoluminal devices involves mounting an endoluminal device on a mandrel, spraying a solution of the therapeutic agent, and applying a suction force within the mandrel. The solution includes a volatile solvent and is sprayed onto the abluminal surface of the mounted endoluminal device. The solvent is allowed to evaporate, leaving the abluminal surface coated with the therapeutic agent. Optionally, a polymer may be dissolved in the solution with the therapeutic agent and solvent, or applied with the solvent to form a separate coating layer from the therapeutic agent.

One difficulty with the above-described method of coating the endoluminal device is the potential for coating defects, and inadvertent application of a coating to the luminal surface during coating of the abluminal surface. While some coating defects can be minimized by adjusting the coating parameters, other defects occur due to the nature of the interface between the endoluminal device and the mandrel on which the endoluminal device is supported during the coating process. Typically, a high degree of surface contact between the endoluminal device and the supporting apparatus can provide regions in which the liquid composition can flow, wick, and collect as the composition is applied. As the solvent evaporates, the excess composition hardens to form excess coating at and around the contact points between the tubular medical device and the supporting apparatus, also referred to as "webbing" of the coating.

Upon the removal of the coated endoluminal device from the supporting apparatus, the excess webbed coating may stick to the apparatus, thereby removing some of the needed coating from the endoluminal device and leaving bare areas. Alternatively, the excess coating may stick to the endoluminal device, thereby leaving excess coating as agglomerations or pools on the struts or webbing between the struts. During implantation of the coated endoluminal device, excess therapeutic agent deposited within the openings in the frame of the endoluminal device may be dislodged upon radial expansion of the coated endoluminal device and fall through the openings into the lumen of the coated device.

Coating mandrels may be coupled to vacuum sources to remove excess coating material from a medical device during the coating process. For example, U.S. Pat. No. 6,818,063 to Kerrigan, filed Sep. 24, 2002, describes a stent mandrel fixture for supporting a stent during the application of a coating substance that includes a hollow perforated central mandrel in fluid communication with a vacuum device. A fluid coating composition applied to a stent mounted around the mandrel passes through openings in the stent, into the perforations in the mandrel and through a bore formed within the mandrel that is in fluid flow communication with the vacuum device.

However, the bore is not structured to facilitate the rapid removal of coating solution fluid through the perforations. For example, eddying currents within the bore may cause uneven rates of suction through the perforations, permitting pooling of coating solution on the surface of the mandrel between openings in the stent. This can lead to webbing of the coating, clogged perforations and/or coating deposition on the abluminal surface of the stent. Thus, there remains a need for coating methods and structures useful to minimize the coating contact with (and deposition of) a coating on the luminal surface of the endoluminal device. There is also a need to minimize webbing of the coating in openings of the coated medical device or agglomeration of coating material on the struts.

SUMMARY

The present disclosure provides devices for supporting an endoluminal device during the coating application process, and methods of using such devices to coat an endoluminal device.

In accordance with one embodiment, a mandrel coating assembly is provided. The coating assembly may include a first member positioned within a second member and a vacuum means. The first member may be a perforated tube extending from a proximal end to a distal end along a longitudinal axis. The first member may have a first outer surface with a first outer diameter and a first luminal surface defining a substantially cylindrical first lumen with a first luminal diameter. A plurality of perforations between the first outer surface and the first luminal surface can be found on the first member. The second member defining a fluid flow channel may be positioned within the first member. The second member may extend along the longitudinal axis from a proximal end to a distal end. The second member also has a second outer surface with a second outer diameter that is less than the first inner diameter of the first member. Preferably, the second outer surface of the second member contacts the first luminal surface of the first member. At least one fluid flow channel can be included along the outer surface of the second member. The at least one fluid flow channel is preferably in fluid communication with the perforations of the first member and the vacuum means. The vacuum means is configured to remove excess therapeutic agent when applied. Portions of the second outer surface adjacent to the at least one fluid flow channel can be in sealable contact with the first luminal surface.

In operation, an endoluminal medical device is secured about the outside surface of the first member of the mandrel coating assembly and a coating solution can be spaced to form a gap from the outer surface of the endoluminal medical device. Coating solution passing through openings in the endoluminal medical device preferably passes through the perforations in the first member and into a fluid flow channel, where the coating solution exits the mandrel coating assembly by action of the vacuum means.

The geometry of the perforations in the first member, the fluid flow channels in the second member and the vacuum means in the mandrel coating assembly may be selected in combination to minimize the coating deposition on the luminal surface of the endoluminal device, as well as webbing of the coating within openings of the endoluminal device (e.g., between the struts and agglomeration of coating materials on the struts). For example, the vacuum means and the configuration of the mandrel coating assembly may be selected such that the rate of fluid flow into the fluid flow channel while coating the medical device is greater than or equal to the rate of coating fluid contacting the endoluminal device.

The fluid flow channels can be disposed along the outer surface of the second member in any suitable pattern, including a helical configuration or longitudinally aligned parallel to the longitudinal axis. The fluid flow channel may have any suitable cross sectional geometry, and the size or shape of the fluid flow channel may vary along the length of the second member. The cross sectional area of one or more fluid flow channels can be substantially constant along the length of the second member or may vary along the length of the second member. For example, the fluid flow channels may taper or widen along the length of the second member. The fluid flow channels may extend from the proximal to the distal end of the second member, or may form a closed loop at the proximal or distal end of the second member. In one example, a fluid flow channel tapers to a narrower cross sectional area at the portion of the fluid flow channel closest to the vacuum means, with the cross sectional area of the fluid flow channel increasing in the direction away from the vacuum means. In another example, the cross sectional area of the fluid flow channel may widen at the proximal and distal ends of the second member, with a portion of the fluid flow channel therebetween having a smaller cross sectional area. Components of the mandrel coating assembly can be disassembled or detachable for easy cleaning.

In accordance with another embodiment, the mandrel coating assembly, as described above, can also include a coating means. The coating means can be for applying a therapeutic agent to at least one tubular medical device. Preferably, the coating means includes an ultrasonic spray deposition device positioned radially outside the mandrel coating assembly. Yet, another embodiment of the mandrel coating assembly may include a coupling member. The coupling member can have a rotating coupling, a connector, and a coupling fluid flow channel. The rotating coupling may be adapted to attach to a terminal end of the first and second members. The connector, moreover, may be adapted to attach to the vacuum means. The coupling fluid flow channel can connect the rotating coupling and the connector, and may be in fluid communication with the vacuum means and the at least one fluid flow channel. Still another embodiment may include a means for rotating the first and second members, a means for retaining the at least one tubular medical device around the first member, or both.

Methods of applying a therapeutic agent to at least one tubular medical device are provided. The methods can include the steps of: providing a mandrel coating assembly, as described above, including a vacuum means for creating a vacuum in fluid communication with the at least one fluid flow channel of the second member, and a coating means for applying a coating solution having the therapeutic agent to the at least one tubular medical device; loading and positioning the at least one tubular medical device around the mandrel coating assembly; applying the coating solution and a solvent onto the outer surface of the at least one tubular medical device with the coating means; and removing said excess coating solution that has collected at the openings of the at least one tubular medical device and the perforations of the first member and within the at least one fluid flow channel of the second member with the vacuum means. Another step can include rotating the first and second members with the loaded at least one tubular medical device with a means for rotating while said applying step is being performed, the means for rotating being configured to couple to the first and second members.

For the purposes of promoting an understanding of the principles of the invention, reference will now be made to the embodiments illustrated in the drawings, and specific language will be used to describe the same. It should nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DETAILED DESCRIPTION

Figure 1A:
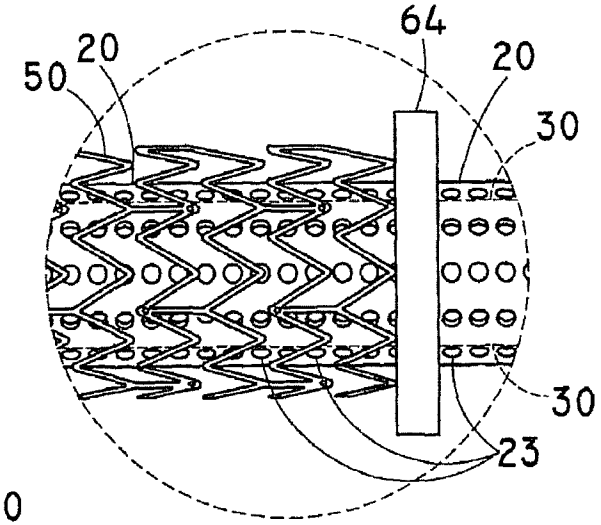
FIG. 1A is detailed view of a portion of the mandrel coating assembly of FIG. 1.

The present disclosure relates methods of coating an endoluminal device, or tubular medical device, and mandrels configured to coat an endoluminal device. For the purposes of promoting an understanding of the principles of the invention, reference will now be made to the embodiments illustrated in the drawings, and specific language will be used to describe the same. It should nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The term "coating," as used herein and unless otherwise indicated, refers generally to material attached to an endoluminal device. A coating can include material covering any portion of a medical device, and can be configured with one or more coating layers. A coating can have a substantially constant or a varied thickness and composition. Coatings can be adhered to any portion of the endoluminal device surface, including the luminal surface, the abluminal surface, or any portions or combinations thereof.

As used herein, the terms "proximal" and "distal" describe longitudinal directions in opposing axial ends of a mounted endoluminal device coating assembly, and components thereof.

As used herein, "securing contact" between an annular projection and a tubular medical device refers to physical contact between a surface of the annular projection and a surface of the tubular medical device that is effective to maintain the tubular medical device in a fixed orientation with respect to the first member or an axial member of the mandrel coating assembly during translational or rotational movement of the axial member.

As used herein, the phrase "therapeutic agent" refers to any pharmaceutically active agent that results in an intended therapeutic effect on the body to treat or prevent conditions or diseases. Preferably, the therapeutic agent is an agent effective to treat or prevent restenosis, such as an antisense agent, a microtubule stabilizing agent or an inhibitor of the mammalian target of rapamycin (mTOR). Preferred therapeutic agents include the paclitaxel.

Figure 1:
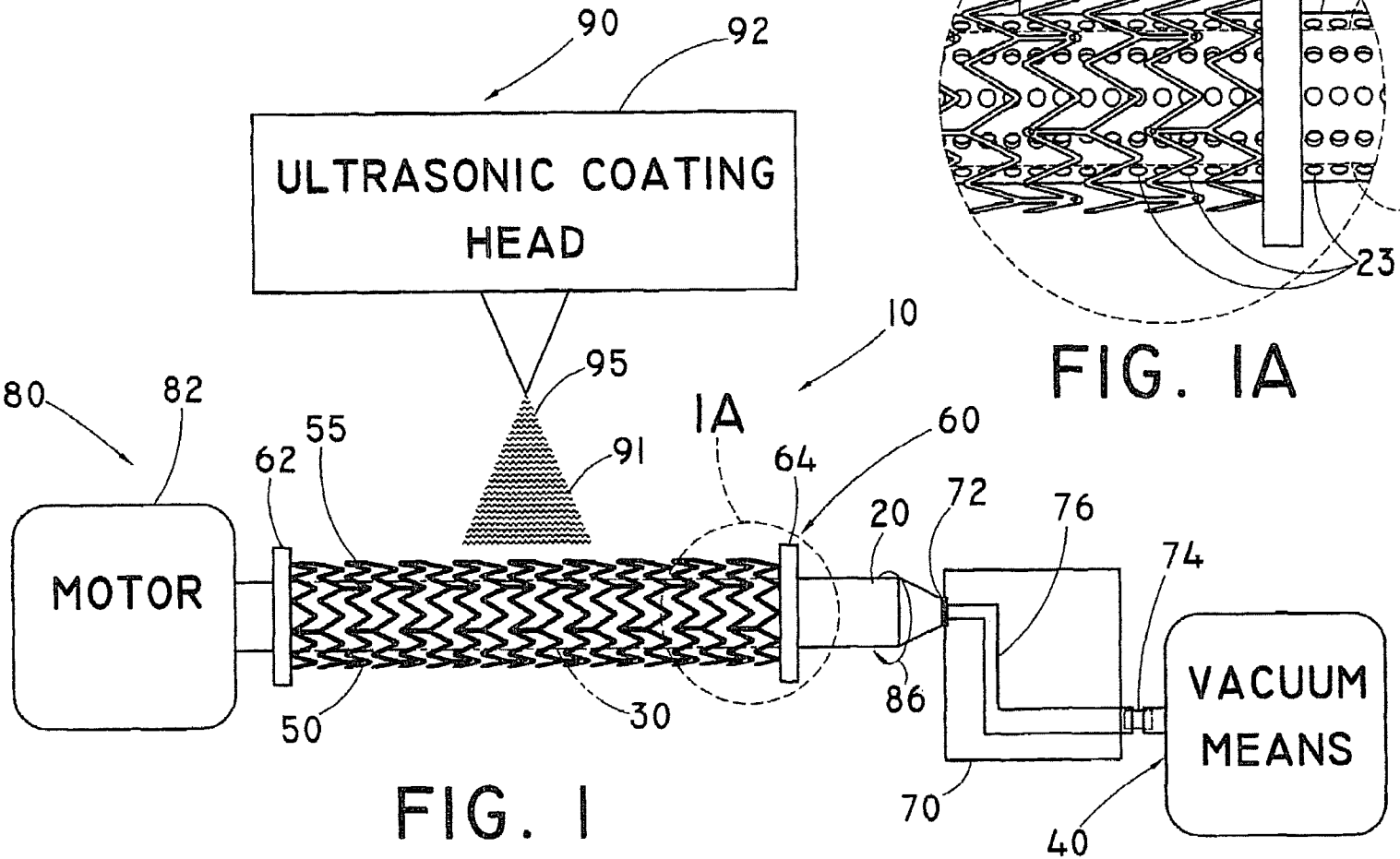
FIG. 1 is perspective view of one embodiment of the mandrel coating assembly.

FIG. 1 shows an illustrative mandrel coating assembly 10 according to several embodiments of the present invention. The mandrel coating assembly 10 can include a first member 20 and a second member 30. Circumferentially positioned around the first member 20 can be a tubular medical device 50 that is in securing contact with a retaining means 60, such as the two annular retaining members 62, 64. FIG. 1A shows a detailed view of the arrangement of the first and second members 20, 30, the retaining member 64, and the tubular medical device 50. Additionally, the mandrel coating assembly 10 can include a means for rotating 80 the mandrel assembly, a coating means 90, and a vacuum means 40. A coupling member 70 may be positioned between the first member 20 and the vacuum means 40. The mandrel coating assembly 10 can also be used to coat a plurality of tubular medical devices. Here, the retaining means 60 may include additional annular retaining members to secure a plurality of tubular medical devices longitudinally positioned along the length of the assembly.

Figure 2A:
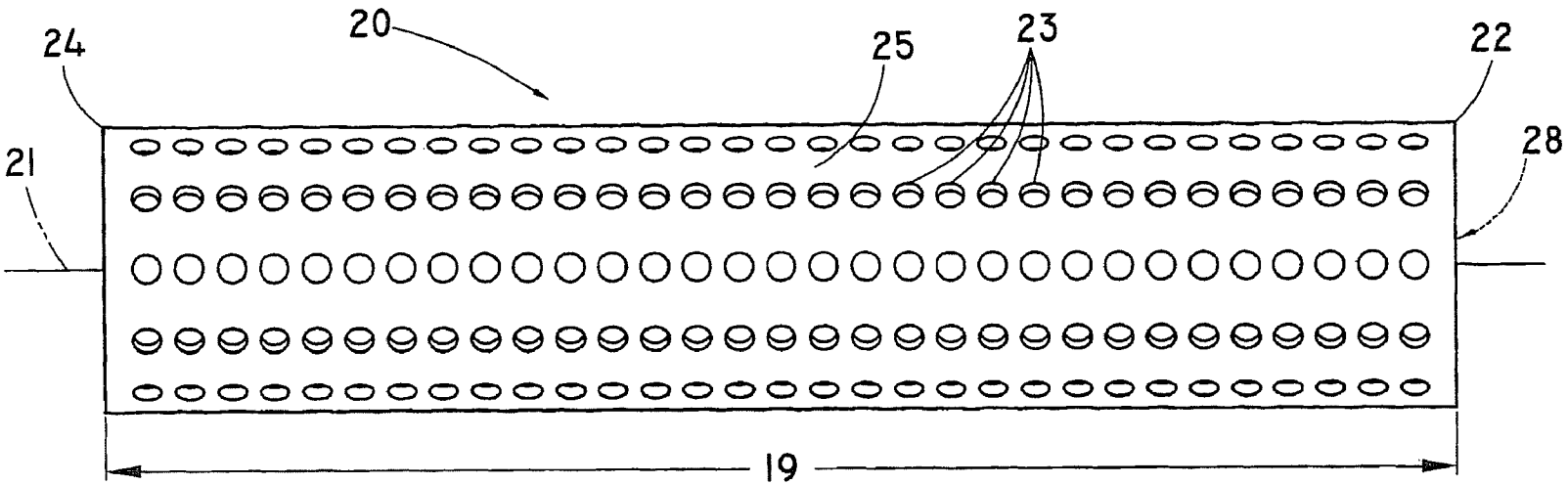
FIG. 2A is a side view of one embodiment of a first member.
Figure 2B:
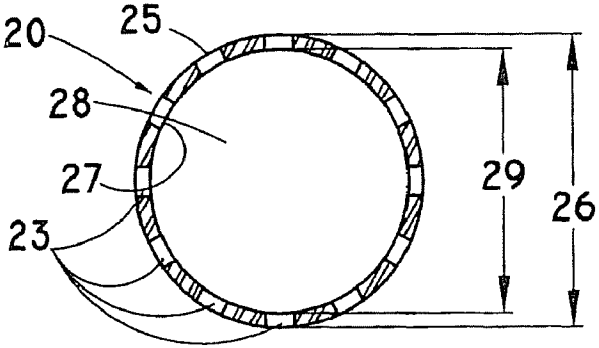
FIG. 2B is a detailed end view of the first member.

Referring to FIGS. 2A and 2B, the first member 20 may be a cylindrical, tubular member oriented along a longitudinal axis 21. The first member 20 may be formed from a rigid material adapted to translate rotational force from a shaft mount throughout the length 19 of the first member 20. For example, the first member 20 may be a stainless steel mandrel having a substantially uniform circular transverse cross-section with a substantially uniform outer diameter along the length of the mandrel. Alternatively, the first member 20 can be made of any suitably rigid materials. The first member 20 has a proximal end 22 and a distal end 24 and extends along the longitudinal axis 21. The first member 20 has an outer surface 25 with an outer diameter 26 and a luminal surface 27 defining a substantially cylindrical lumen 28 with a luminal diameter 29. The shaft mount may have a circular transverse cross-section with a diameter that is greater than the first outer diameter 26 or less than the first luminal diameter 29 when mounted to the mandrel coating assembly 10.

The first member 20 may also have a portion having a plurality of perforations 23. The perforations 23 extend between the outer surface 25 and the luminal surface 27. The perforations 23 can be in fluid communication with the lumen 28 of the first member 20. The perforations 23 can be of any size and number to effectively allow a coating, or a coating solution 91 described herein, to be vacuumed from the tubular medical device 50 and through the perforations 23. Typically, the effectiveness of the size and number of the perforations 23 depends on the properties and composition of the coating solution 91, the power of the suction force applied by the vacuum means 40, the volume of fluid flow channels 31, and the volume of the openings 53 of the tubular medical device 50.

The perforations 23 may have cross-sectional areas that are substantially the same or different. Moreover, the perforations 23 can have any shape, such as circular, rectangular, star-shaped, or any other polygon. The density of perforations 23 per unit area of the first member 20 may be the same or may differ along the length of the first member 20. In one aspect, the total cross sectional area of the perforations 23 along the length of the first member 20 may differ along the length of the first member 20. For example, a first portion of the first member 20 positioned closest to the vacuum means 40 may have a lower total cross sectional area of perforations 23 than a second portion of the first member 20 positioned farther from the vacuum means 40 than the first portion. The perforations 23 are preferably positioned in fluid flow communication with at least one fluid flow channel 31 in the second member, as described below. Construction of perforations 23 can be accomplished by any means known in the art. Additionally, the perforations 23 can be disposed along the entire length 19 or only a portion of the first member 20 that is adjacent to the disposed tubular medical device. Preferably, the perforations 23 are circumferentially distributed around the entire length 19 of the first member 20 as shown in FIG. 2A.

Figure 3A:
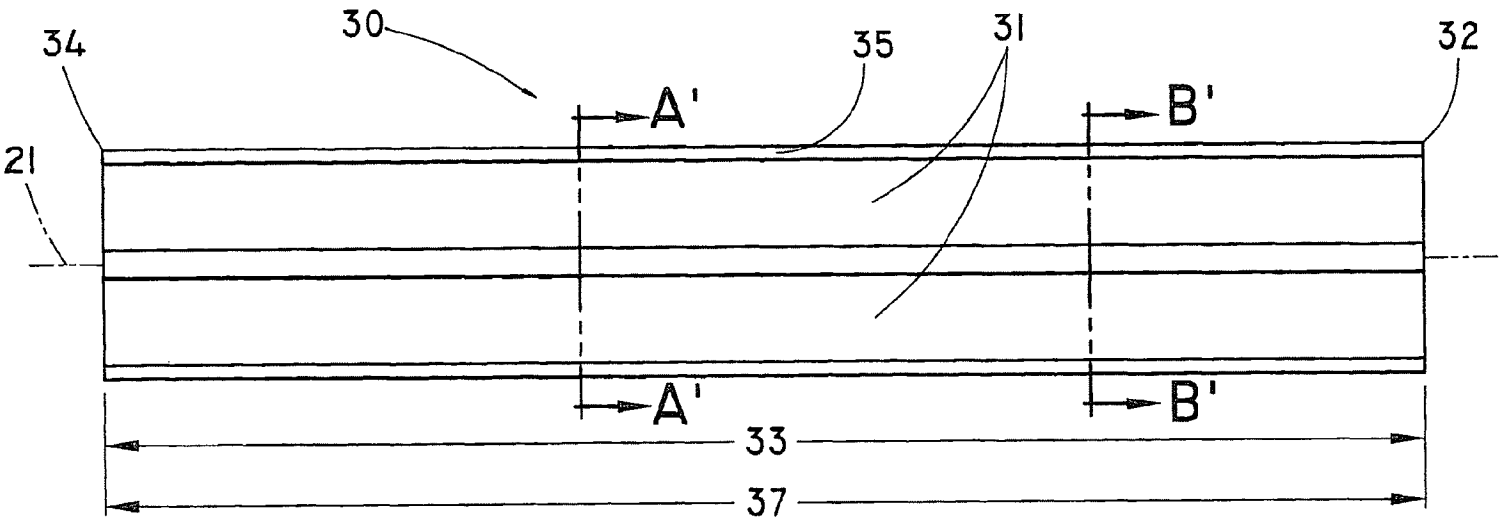
FIG. 3A is a side view of one embodiment of a second member.
Figure 3C:
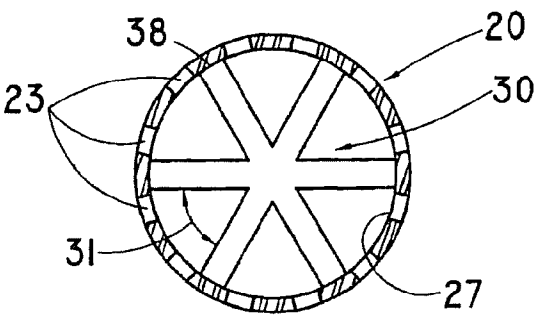
FIG. 3C is a detailed end view of the second member being positioned within the first member.
Figure 3B:
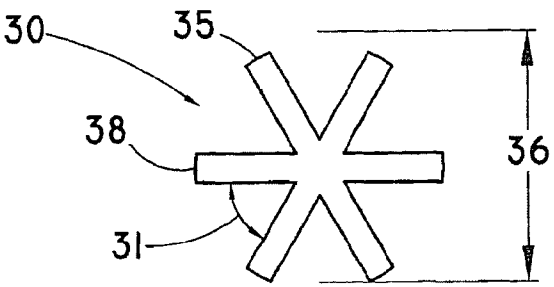
FIG. 3B is a detailed end view of the second member.

In FIGS. 3A and 3B, the second member 30 may be a solid cylindrical member oriented along the longitudinal axis 21. The second member 30 may further be formed from a rigid material adapted to translate rotational force from the shaft mount throughout the length 37 of the second member 30. For example, the second member 30 may be a stainless steel mandrel having a substantially uniform circular transverse cross-section with a substantially uniform outer diameter along the length of the mandrel. Alternatively, the second member 30 can be made of any material known by one of ordinary skill in the art. The second member 30 of the mandrel coating assembly 10 may also have a proximal end 32 and a distal end 34 and may extend along the longitudinal axis 21 of the first member 20. The second member 30 may have an outer surface 35 with the outer diameter 36. Furthermore, the second member 30 can have at least one fluid flow channel 31 in fluid communication with the perforations 23 of the first member 20. In relation to the first lumen 28, a portion of the second member 30 can be positioned within the first lumen 28. Preferably, the entire second member 30 is positioned within the first lumen 28 of the first member 20. FIG. 3C illustrates an end view of the second member 30 positioned within the first member 20. Additionally, the longitudinal length 37 of the second member 30 can be substantially the same as a longitudinal length 19 of the first member 20. Alternatively, the longitudinal length 37 of the second member 30 can be less than or greater than the longitudinal length 19 of the first member 20.

A portion 38 of the outer surface 35 of the second member 30 adjacent to the a fluid flow channel 31 can be in contact with the first luminal surface 27 of the first member 20, as shown in FIG. 3C. Preferably, the outer surface 35 is in sealable contact with first luminal surface 27 of the first member 20. In other words, the outer surface 35 defining the outer surface of the second member 30 is dimensioned to contact snugly the first luminal surface 27 of the first member 20 to effectively seal along the fluid flow channels 31. This may permit the better suction of the coating solution 91 through the perforations 23 and through the fluid flow channels 31. Preferably, the outer diameter 36 of the second member 30 is substantially the same, or just slightly less than, the first luminal surface 27 of the first member 20 to still be able to snugly fit the second member 30 within the first lumen 28 of the first member 20. The area of contact between the outer surface 35 and the first luminal surface 27 can also provide enough support to the first member 20 and the tubular medical device 50.

Figure 4B:
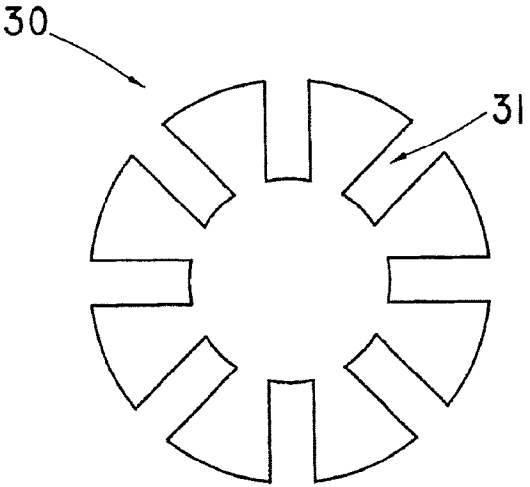
FIG. 4B is a detailed end view of another embodiment of the second member.
Figure 4A:
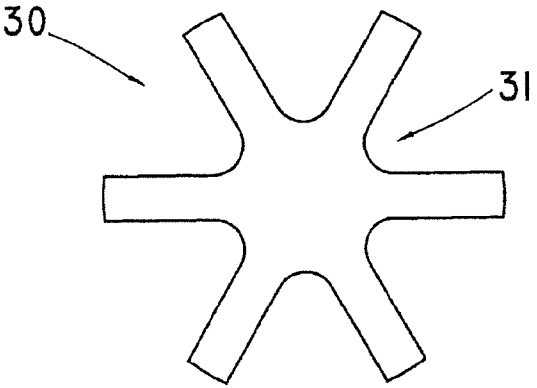
FIG. 4A is a detailed end view of another embodiment of the second member.

Construction of the fluid flow channel 31 in the second member 30 can occur by any means known in art, preferably by machining or milling. Typically, the effectiveness of the size and number of the fluid flow channels 31 depends on the viscosity and composition of the coating solution 91, the strength of the suction force applied by the vacuum means 40, the volume of the fluid flow channels 31, and the volume of the openings 53 of the tubular medical device 50. Moreover, the shape of fluid flow channels 31 can be any shape, such as V-groove (FIG. 3B), round nose or U-groove (FIG. 4A), or dado or rectangular (FIG. 4B). Preferably, the flow channels 31 have a U-groove shape with tapered sides. The sides taper to a wider inlet to draw from multiple perforations 23, while the smaller radius of curvature on the rounded channel portion can provide a faster rate of flow along that portion of the channel. Each fluid flow channel 31 can be circumferentially spaced substantially equal from the next adjacent fluid flow channel.

Figure 5B:
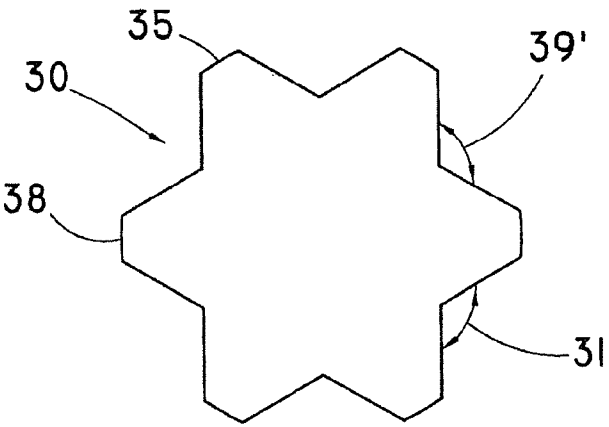
FIG. 5B is along line B-B' in FIG. 3A of a second member having fluid flow channel with a varied cross-section.
Figure 5A:
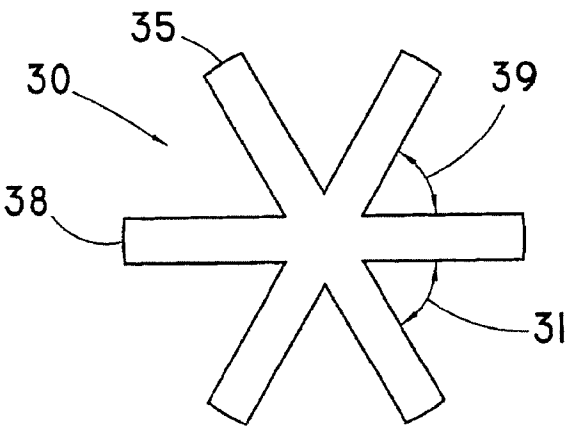
FIG. 5A is along line A-A' in FIG. 3A of a second member having fluid flow channel with a varied cross-section.

Furthermore, the cross sectional area 39 of the fluid flow channel 31 can vary along the length 37 of the second member 30 to vary the flow rate of suction along the channel. For example, cross-sectional views corresponding to positions A-A' (FIG. 5A) and position B-B' (FIG. 5B) in the second member 30 shown in FIG. 3A are illustrated. For example, the cross sectional area 39 of the channel 31 at position A-A' may be more than the cross sectional area 39' of an adjacent region, as shown in FIGS. 5A-B. In some examples, the cross-sectional area 39 may be less at the coating region, or the region where the tubular medical device is to be coated and greater at portions adjacent to the narrower region. This generally will create an increased velocity of fluid along the narrower region adjacent to the coating region, and correlated pressure drop, within that region of within the channels 31.

In another embodiment, the second member 30 can be constructed with a plurality of protrusions or bumps on the exterior surface, instead of defined channels. The bumps can be arranged in similar fashion as to the channels to provide areas between the bumps for suction and where the top of the bumps can contact the first member. The depth of the area or valley between the bumps can be modified to increase the cross-sectional area, similar to modification of the channels 31 in FIGS. 5A and 5B. The bumps can potentially eliminate any remaining dead air flow zones over the perforated section of the first member to get completely uniform suction over the length of the coating mandrel assembly.

Figure 6A:
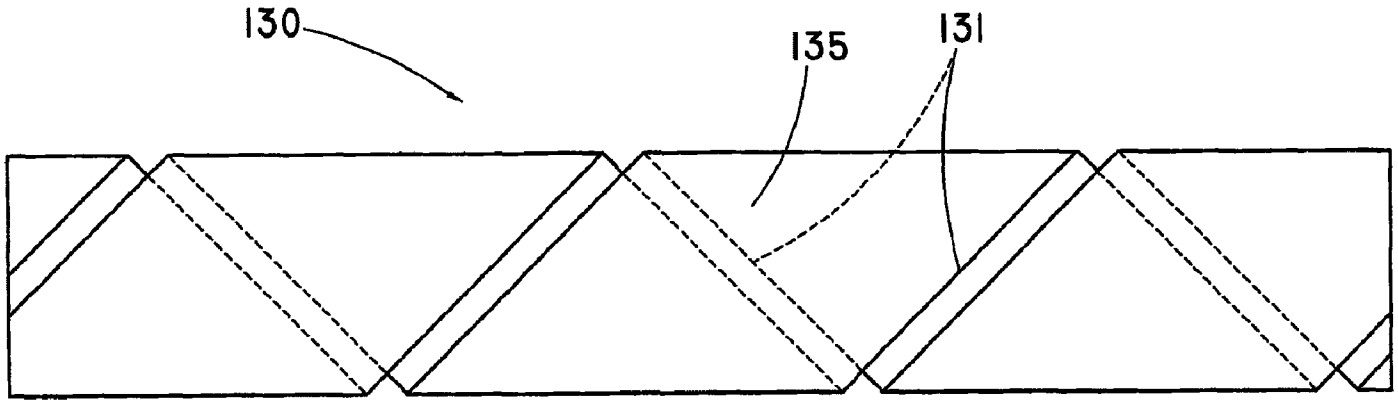
FIG. 6A is a side view of another embodiment of a first second member.

A length 33 of the fluid flow channel 31 within the second member 30 can be any length. Preferably, the length 33 of the fluid flow channel 31 is substantially the same as the length 37 of the second member 30, as shown in FIG. 3A, or is a distance measured from the proximal end 32 to the distal end 34 of the second member 30. The configuration of the fluid flow channel 31 can extend substantially parallel to the longitudinal axis 21, as shown in FIG. 3A. Alternatively, the configuration of the fluid flow channel 131 can extend helically around the outer surface 135 of the second member 130, as shown in FIG. 6A. The fluid flow channels 131 in these configurations can be isolated from another and used with the vacuum means 40 to create suction.

Figure 6B:
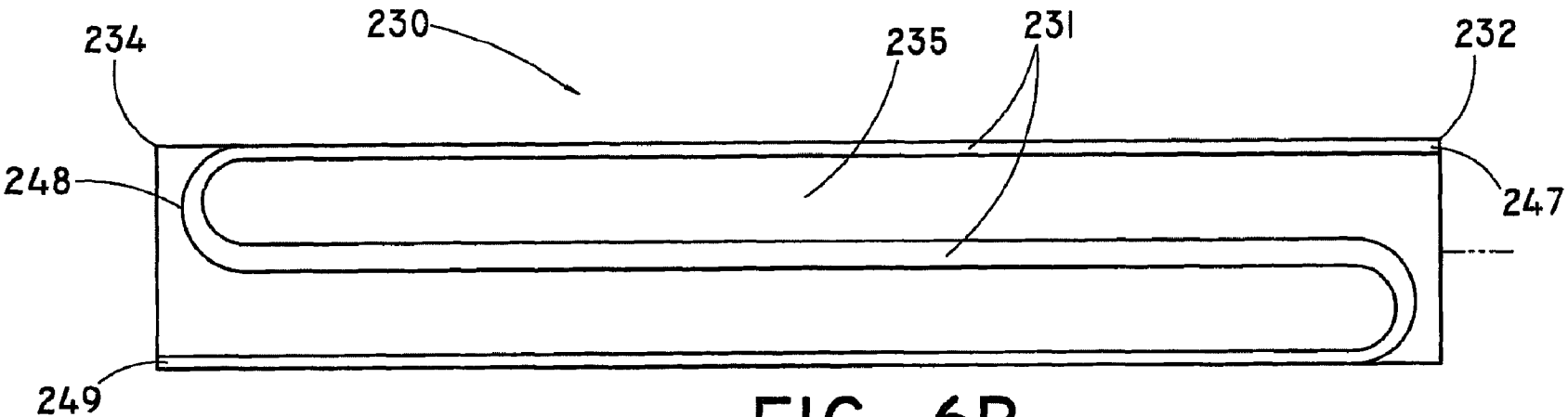
FIG. 6B is a side view of another embodiment of a second member.

In FIG. 6B, however, the fluid flow channels 231 are connected to one another (i.e., the fluid flow channels 231 are connected between a first terminal end 247 and a second terminal end 249 by at least one union 248). With this configuration, the vacuum means 40 would preferably be the fluid pump. The first terminal end 247 of a first fluid flow channel 231 can be at one of the distal and proximal ends 232, 234 of the second member 230 and in fluid communication with the vacuum means 40. The second terminal end 249 can be at the same distal or proximal end 232, 234 of the first terminal end 247 or at the opposite end as shown in FIG. 6B. At the second terminal end 249, the fluid can be collected and the excess can be filtered for reuse.

Figure 6C:
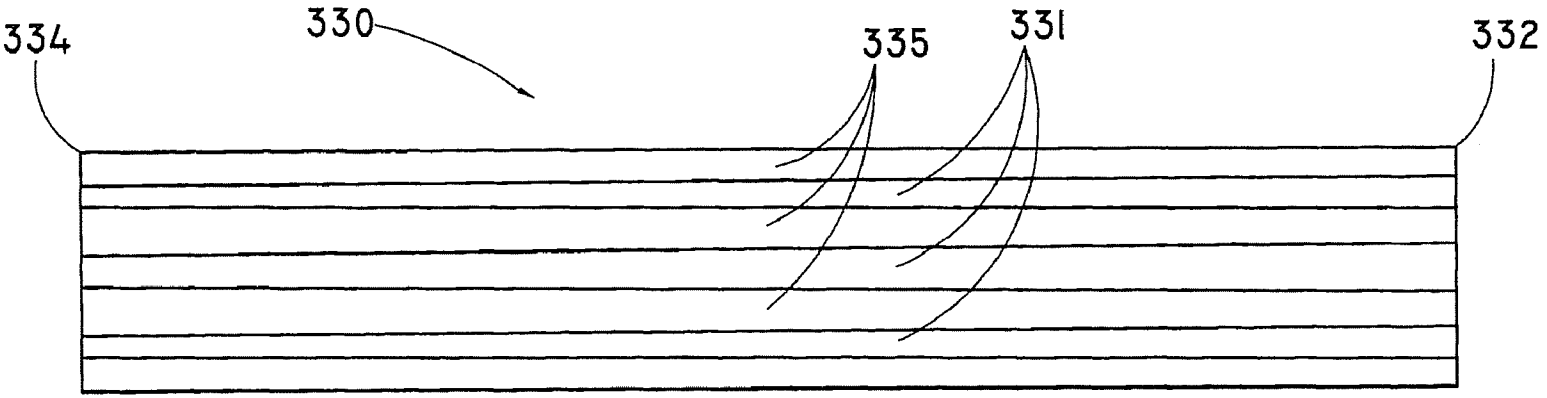
FIG. 6C is a side view of another embodiment of a second member.

In another embodiment shown in FIG. 6C, the width of the fluid flow channels 331 in the second member 330 taper between a wider proximal end 332 and a narrower distal end 334. With this configuration, the vacuum means would preferably be positioned closest to the narrower distal end 334 to promote a faster fluid rate. The second member 330 is otherwise identical to the first second member 30. Portions of the outer surface 335 positioned between the fluid flow channels 331 extend radially from the longitudinal axis of the second member 330. The outer surface 335 is dimensioned and configured to form a seal with a first member 20 described above when assembled as a mandrel coating assembly. Within the mandrel coating assembly, the tapering of the fluid flow channels 331 may accelerate the rate of fluid flow along the length of the second member 330, thereby increasing the rate of suction through the perforations 23 in the first member 20. The increased rate of fluid flow within the fluid flow channels 331 may beneficially reduce the incidence of undesirable deposition of coating material within openings of the endoluminal medical device positioned around the mandrel coating assembly.

Figure 6D:
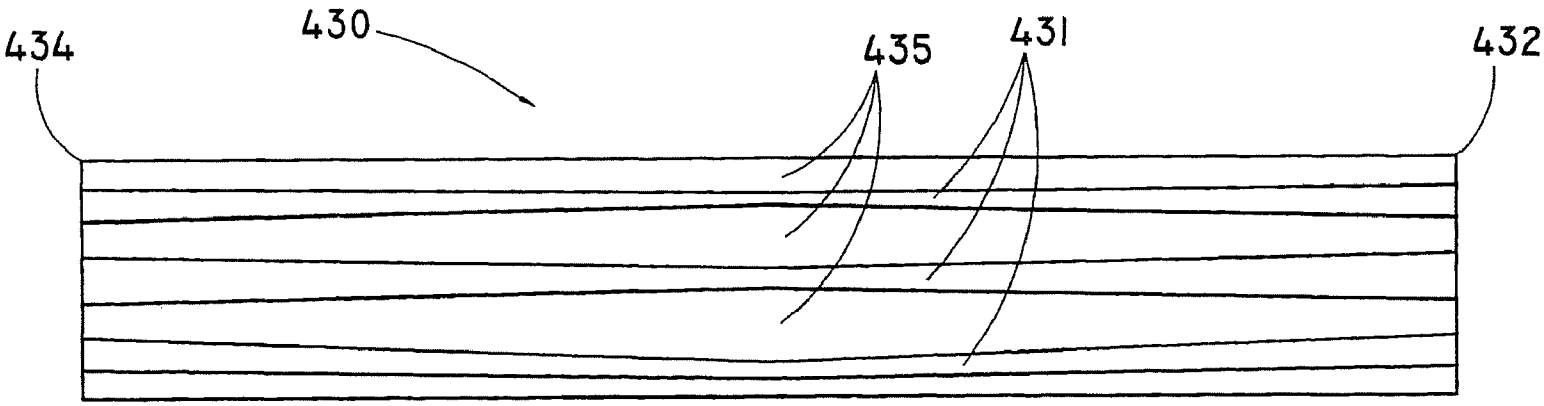
FIG. 6D is a side view of another embodiment of a second member.

In another example shown in FIG. 6D, the width of the fluid flow channels 431 in the second member 430 taper from both a proximal end 432 and a distal end 434 toward a narrow central portion. The cross sectional area of the fluid flow channels 431 at the proximal end 432 and the distal end 434 can be the same or different. With this configuration, if the proximal end 432 had a smaller cross sectional area than the distal end 434, the vacuum means would preferably be positioned closest to the narrower proximal end 432 (or vice versa). The second member 430 is otherwise identical to the second member 30. Portions of the outer surface 435 positioned between the fluid flow channels 431 extend radially from the longitudinal axis of the second member 430. The outer surface 435 is dimensioned and configured to form a seal with a first member 20 described above when assembled as a mandrel coating assembly. Within the mandrel coating assembly, the bidirectional tapering of the fluid flow channels 431 (e.g., a "dog bone" configuration) may accelerate the rate of fluid flow along portions of the length of the second member 430, thereby increasing the rate of suction through the perforations 23 in the first member 20. The increased rate of fluid flow within the fluid flow channels 431 may beneficially reduce the incidence of undesirable deposition of coating material within openings of the endoluminal medical device positioned around the mandrel coating assembly, especially at the proximal and distal ends of the endoluminal medical device. In addition, the configuration of the fluid flow channels 431 may provide for the deposition of lower doses of the coating composition at the proximal and distal ends of the endoluminal medical device.

Referring back to FIG. 1, the mandrel coating assembly 10 further includes a vacuum means 40 for creating a vacuum or suction. The vacuum means 40 can be selected from the group consisting of a suction device and a fluid pump. The vacuum means 40 can be in fluid communication with each fluid flow channel 31 of the second member 30. The suction force of the vacuum means 40 should be an effective force to minimize coating defects and excess coating solution 91 from forming in the openings 53 of the tubular medical device 50 and the underneath luminal surface 57 of the tubular medical device 50.

If the vacuum means 40 is a suction device, the suction device can generate a suction force within the fluid flow channels 31 of the second member 30. This can create a pressure drop of at least 0.1 inches water gage pressure or greater between the openings 53 of the tubular medical device 50, the perforations 23 of the first member 20, and the fluid flow channels 31 of the second member 30. The pressure gradient between this region within the fluid flow channel 31 and the ambient pressure of the openings 53 of the tubular medical device 50 should be effective to propel excess coating solution 91 toward the lower pressure region of the fluid flow channels 31.

If the vacuum means 40 is a fluid pump, the fluid pump passes fluid, generally air, through the fluid flow channels 231 from the first terminal end 247 out of the second terminal end 249. The fluid pumped should be at effective pressure and velocity as to bypass most of the perforations 23 of the first member 20 and to overcome the friction loss of the fluid flow channels 231. When the stream of fluid passes through the fluid flow channels 231, air can be pulled through the openings 53 of the tubular medical device 50 and perforations 23 of the first member 20 with the stream of fluid. "Suction" is thus created at the perforations 23, resulting in a low pressure, vacuum. These fluid streams, the fluid pumped and the excess coating solution 91, are mixed and discharged. There can be many design considerations, including defining the flow rates of the fluid pump, fluid properties, and pressures at the motive, the suction, and the discharge. If variable cross sectional fluid flow channels 31 are used with a higher pressure at the discharge, the discharge pressure, discharge fluid flow channel size, and discharge fluid flow channel geometry can also become other considerations.

Regardless of the vacuum means 40 selected, the vacuum means 40 can create an effective pressure drop. The effective pressure drop can create a suction force that pulls excess coating solution 91 through the openings 53, and the perforations 23, and the fluid flow channels 31 into either the vacuum device of the vacuum means 40 or a repository. The excess coating solution 91 can then be used for storage or recycling for reapplication of the coating solution 91 or for disposal.

Figure 7A:
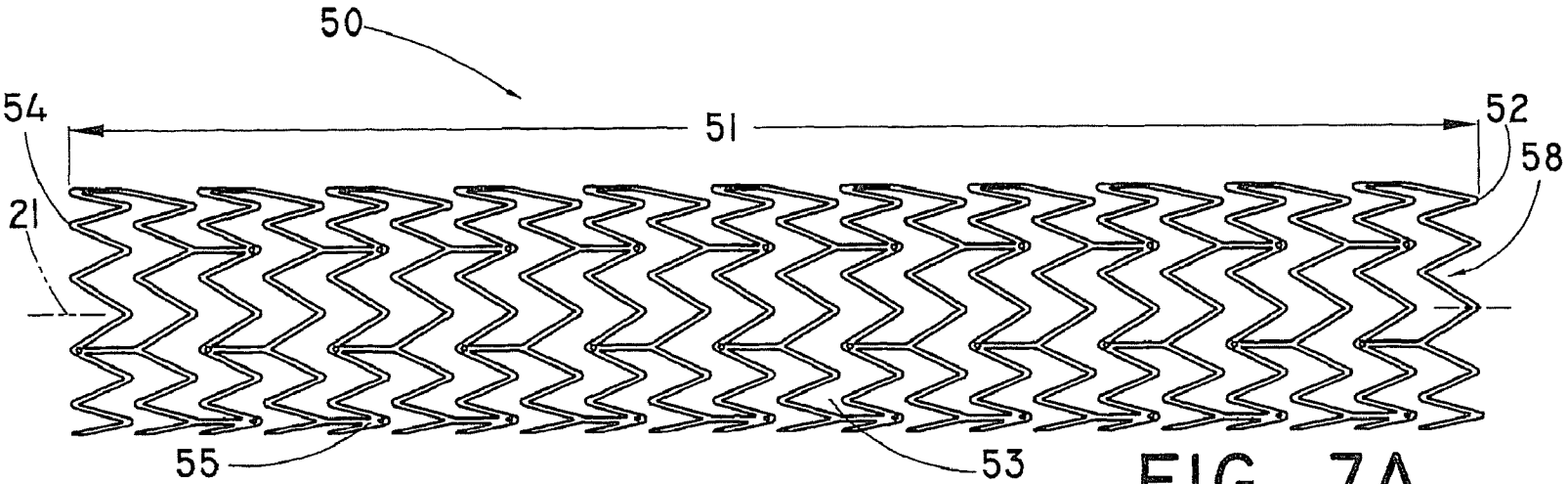
FIG. 7A is a side view of an illustrative tubular medical device.
Figure 7B:
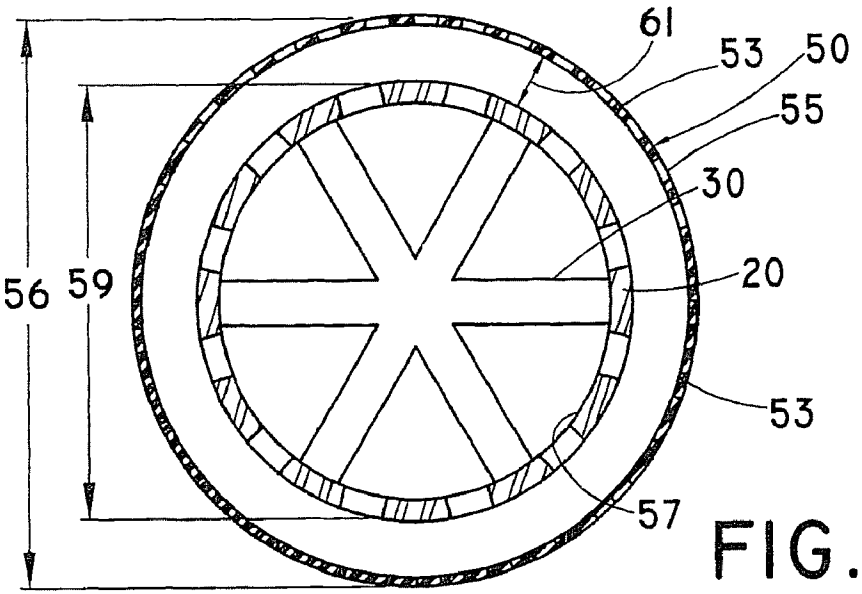
FIG. 7B is a detailed end view of the tubular medical device circumferentially positioned around the first member and the second member.

A tubular medical device 50 is illustrated in FIG. 7A, and may be positioned around the mandrel coating assembly 10. FIG. 7B is illustrative of an end view of the tubular medical device 50 around the mandrel coating assembly 10. Typically, the tubular medical device 50 can be circumferentially disposed around the first member 20 and may extend from a proximal end 52 to a distal end 54 along the longitudinal axis 21. The tubular medical device 50 can have an outer surface 55 with an outer diameter 56. Moreover, the tubular medical device 50 can have a luminal surface 57 defining a substantially cylindrical lumen 58 with a luminal diameter 59. The tubular medical device 50 typically has a plurality of openings 53 between the outer surface 55 and the luminal surface 57.

In general, the tubular medical device 50 may comprise a plurality of openings 53 or open spaces between metallic filaments (including fibers and wires), segments or regions. Typical structures include: an open-mesh network comprising one or more knitted, woven or braided metallic filaments; an interconnected network of articulable segments; a coiled or helical structure comprising one or more metallic filaments; and, a patterned tubular metallic sheet (e.g., a laser cut tube). The openings 53 of the tubular medical device 50 can be in fluid communication with the perforations 23 of the first member 20. The luminal surface 57 of the tubular medical device 50 can be in contact with the outer surface 25 of the first member 20 to help prevent coating on the luminal surface 57.

Examples of a tubular medical device 50, or endoluminal device or stent, include endovascular, biliary, tracheal, gastrointestinal, urethral, ureteral, esophageal and coronary vascular stents. The tubular medical device 50 of the present invention may be, for example, balloon-expandable or self-expandable. A tubular medical device 50 may include a plurality of interconnected struts and bends in a plurality of longitudinally connected sinusoidal hoop members. The tubular medical device 50 may be radially expandable from a compressed configuration to a radially expanded configuration. More specifically, the tubular medical device 50 may be, for example, a Wallstent, Palmaz-Shatz, Wiktor, Strecker, Cordis, AVE Micro Stent, Igaki-Tamai, Millenium Stent (Sahajanand Medical Technologies), Steeplechaser stent (Johnson & Johnson), Cypher (Johnson & Johnson), Sonic (Johnson & Johnson), BX Velocity (Johnson & Johnson), Flexmaster (JOMED) JoStent (JOMED), S7 Driver (Medtronic), R-Stent (Orbus), Tecnic stent (Sorin Biomedica), BiodivYsio (Abbott), Trimaxx (Abbott), DuraFlex (Avantec Vascular), NIR stent (Boston Scientific), Express 2 stent (Boston Scientific), Liberte stent (Boston Scientific), Achieve (Cook/Guidant), S-Stent (Guidant), Vision (Guidant), Multi-Link Tetra (Guidant), Multi-Link Penta (Guidant), or Multi-Link Vision (Guidant). Some exemplary stents are also disclosed in U.S. Pat. No. 5,292,331 to Boneau, U.S. Pat. No. 6,090,127 to Globerman, U.S. Pat. No. 5,133,732 to Wiktor, U.S. Pat. No. 4,739,762 to Palmaz, and U.S. Pat. No. 5,421,955 to Lau. Desirably, the stent is a vascular stent such as the commercially available Gianturco-Roubin FLEX-STENT®, GRII™, SUPRA-G, ZILVER or V FLEX devices from Cook Incorporated (Bloomington, Ind.).

Referring back to FIG. 1, the tubular medical device 50 may be mounted and retained on the mandrel coating assembly 10 and first member 20 by a means 60 for retaining. The means 60 for retaining can provide a securing contact of the tubular medical device 50. The means 60 for retaining can be selected from the group consisting of two annular retaining members, friction-fit, and wire for securing. Preferably, the means 60 for retaining includes two annular retaining members, a first annular retaining member 62 and a second annular retaining member 64, as shown in FIG. 1.

Preferably each of the annular retaining member 62, 64 has substantially identical ring shape and has at least one surface configured to securely contact the tubular medical device 50 mounted on mandrel coating assembly 10. The first annular retaining member 62 may be affixed to the first member 20, while the second annular retaining member 64 may be translated along the first member 20 and locked into a desired place. For instance, the first member 20 and the second annular retaining member 64 may include a means for securing the second annular retaining member 64 at one or more positions along the first member 20. Such means for securing can include an interlocking set of complementary projections and apertures on the second annular retaining member 64 and the first member 20.

The annular retaining members 62, 64 are preferably formed from the same material as the first member 20. Alternatively, any material can be used that may allow the annular retaining members 62, 64 to attach fixedly to the first member 20 and have sufficient rigidity to translate physical motion of the first member 20 to the tubular medical device 50 in securing contact with the annular retaining members 62, 64. The first annular retaining member 62 can be attached to the first member 20 by any suitable means, including adhesives or soldering. Another embodiment may include having each annular retaining member 62, 64 capable of being translated along the first member 20 and locked into a desired place.

Each annular retaining member 62, 64 may have a diameter that is greater than both the first member 20 and the outer diameter 56 of the tubular medical device 50 in the expanded configuration. The proximal and distal ends 52, 54 of the tubular medical device 50 may be in securing contact with the first annular retaining member 62 and the second retaining member 64, respectively, to maintain the tubular medical device 50 with the luminal surface 57 around and substantially parallel to the first member 20. The luminal surface 57 of the tubular medical device 50 preferably has a gap 62, shown in FIG. 7B, and does not contact the first member 20. The gap 62 can permit airflow to be pulled into the perforations 23 of the first member 20 from multiple directions, which can prevent the capillary effect or wicking of the coating spray from the tubular medical device 50 and/or the openings 53 thereof. Alternatively, the luminal surface 57 of the tubular medical device 50 may contact the outer surface of the first member 20.

Preferably, the total cross sectional area of the perforations 23 in the first member 20, the total volume of the fluid flow channels 31 in the second member 30, the coating means 90 and the vacuum means 40 are selected such that any coating solution 91 passing through openings 53 in the tubular medical device 50 passes through the perforations 23 with minimal or no contact with the outer surface 25 of the first member 20. Pooling of coating solution 91 on the first outer surface 25 of the first member 20 is preferably minimized or avoided. In addition, the coating assembly is preferably configured such that carrier gas present in the solution spray 91 passes rapidly through the perforations 23 so as to minimize formation of eddying currents that may direct solutes in the coating solution spray 91 (e.g., a therapeutic agent) passing through openings in the tubular medical device 50 away from the perforations 23. Where the inner surface of the tubular medical device 50 is radially spaced apart from the outer surface 25 of the first member 20 in the mandrel coating assembly, the perforations 23 and fluid flow channels 31 are preferably dimensioned to remove spray coating solution 91 from the interstitial space between the first member 20 and the tubular medical device 50, preventing incidental coating of the inner surface of the inner surface of the tubular medical device 50. For example, the volume of the fluid flow channels 31 may be greater than the cylindrical interstitial volume defined between the inner surface of the tubular medical device 50 and the outer surface 25 of the first member 20.

In one aspect, the tubular medical device 50 may be positioned and mounted on the mandrel coating assembly 10 by: (1) removing the second annular retaining member 64 from the mandrel coating assembly 10, (2) positioning the tubular medical device 50 around the distal end 24 of the first member 20, (3) longitudinally translating the tubular medical device 50 toward the proximal end 22 of the first member 20 until the proximal end 52 of the tubular medical device 50 contacts the first annular retaining member 62, (4) positioning the second annular retaining member 64 around the distal end 24 of the first member 20 and sliding the second annular retaining member 64 toward the proximal end 22 of the first member 20 to bring the second annular retaining member 64 into securing contact with the distal end 54 of the tubular medical device 50 and (5) securing the second annular retaining member 64 to the first member 20 to secure tubular medical device 50 to the mandrel coating assembly 10. Preferably, the tubular medical device 50 is disposed radially outward from the first member 20 by a distance of the gap 61.

In FIG. 1, the mandrel coating assembly 10 can also include a coupling member 70. The coupling member 70 can have a rotating coupling 72 and a connector 74, and a coupling fluid flow channel 76 that connects the rotating coupling 72 and the connector 74. The coupling fluid flow channel 76 can be in fluid communication with the vacuum means 40 and in fluid communication with the at least one fluid flow channel 31 of the second member 30. The rotating coupling 72 may be adapted to attach to at least one of the distal end 24 and the proximal end 22 of the first member 20. The connector 74 is configured to connect to the vacuum means 40.

Also in FIG. 1, the mandrel coating assembly 10 can also include a means 80 for rotating the first and second members 20, 30 about the longitudinal axis 21. Preferably, the mandrel coating assembly 10 is rotated while coating the tubular medical device 50 mounted thereto. The means 80 for rotating can be selected from the group consisting of motor and crank. Preferably, the means 80 for rotating comprise a motor 82 that provides a rotational motion, shown by arrows 86, to the first and second members 20, 30 and the tubular medical device 50. The first member 20 may be attached to the means 80 for rotating. In FIG. 1, the proximal end of the shaft mount is adapted to securely receive the proximal end 22 of the first member 20 and impart rotational motion thereto. The first member 20 may be secured to the shaft mount by any conventional means, including a screw, bolt, adhesive, weld or other retaining means.

Referring again to FIG. 1, the mandrel coating assembly 10 can also include a coating means 90 for applying a coating solution 91 to the tubular medical device 50. The coating means 90 can be selected from the group consisting of dipping, spraying, vapor deposition, plasma polymerization, electrodeposition, and ultrasonic spray deposition. Preferably, the coating means 90 is ultrasonic spray deposition, with the ultrasonic spray deposition device 92 preferably positioned radially outside the mandrel coating assembly 10.

A tubular medical device 50 mounted on a mandrel coating assembly 10 may be coated with a therapeutic agent 95. The mandrel coating assembly 10 may be configured to localize coating of the therapeutic agent 95 to the outer surface 55 of the tubular medical device 50 and prevent or reduce coating irregularities such as "webbing," and improve coating uniformity. The therapeutic agent 95 may be applied by spraying a coating solution 91 including the therapeutic agent 95 and a solvent onto the outer surface 55 of the tubular medical device 50 mounted on the mandrel coating assembly 10. The coating solution 91 preferably includes the therapeutic agent 95 and the solvent. The solvent may be selected to dissolve the therapeutic agent 95 and readily evaporate within the spray or on the outer surface 55 of the tubular medical device 50. For example, a coating solution 91 may include paclitaxel dissolved in an organic solvent.

Figure 8:
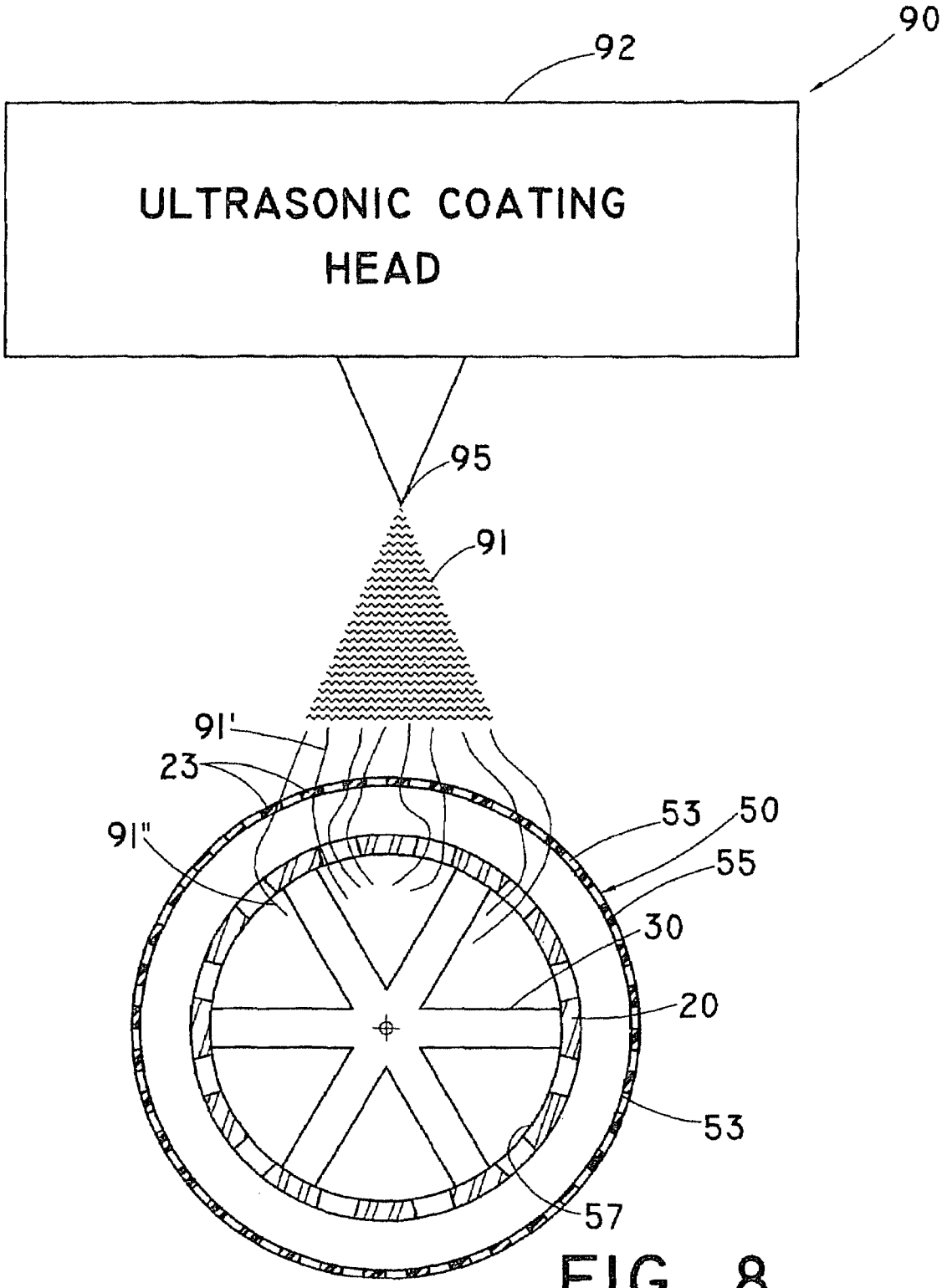
FIG. 8 is a detailed end view of the tubular medical device and the coating means.

FIG. 8 is a cross sectional view in FIG. 1, showing a coating solution spray 91' exiting a nozzle and contacting the outer surface 55 of the tubular medical device 50. The coating solution 91 containing the therapeutic agent 95 is passed through the nozzle in a manner effective to atomize the coating solution 91 to form the spray 91'. A portion 91" of the spray 91' can pass through the openings 53 and onto a portion of the outer surface 55 of the tubular medical device 50 and can contact the first member 20. Preferably, the shape of the spray 91' may be a conical plume controlled such that the maximum distance across the spray 91' is less than the outer diameter 26 of the first member 20. The shape of the spray 91' may be controlled by the size and shape of the nozzle and the pressure applied to the coating solution 91.

In FIG. 8, the portion 91" of the spray 91' preferably terminates within the fluid flow channel 31 of the second member 30. That is, the outer diameter 26 of the first member 20 may be large enough to occlude the portion 91" of the spray 91' from directly contacting the luminal surface 57 of the tubular medical device 50 opposite the position of the nozzle. The first member 20 can act as a masking element for the luminal surface 57 of the tubular medical device 50 during the coating process. That is, to ensure that the droplets of the spray 91' which do not directly contact the tubular medical device 50 are unable to migrate through airflow dynamic onto the luminal surface 57 of the tubular medical device 50. Even if a portion 91" of the spray 91' indirectly contacts the luminal surface 57 of the tubular medical device 50, the suction force through the perforations 23 of the first member 20 and through the fluid flow channel 31 should be enough to remove such portion 91" of spray 91'. The mounted tubular medical device 50 is preferably rotated during the spray coating process. The nozzle may be rastered longitudinally along the length of the first member 20 to apply a coating solution spray 91' along the length of the tubular medical device 50.

Preferably, the therapeutic agent 95 is coated onto an implantable tubular medical device 50 by an ultrasonic spray deposition (USD) process using the ultrasonic spray deposition device 92. The tubular medical device 50 may be coated using an ultrasonic spray nozzle, such as those available from Sono-Tek Corp., Milton, N.Y. Ultrasonic nozzles employ high frequency sound waves generated by piezoelectric transducers which convert electrical energy into mechanical energy. The transducers receive a high frequency electrical input and convert this into vibratory motion at the same frequency. This motion is amplified to increase the vibration amplitude at an atomizing surface. The ultrasonic nozzle may be configured such that excitation of the piezoelectric crystals creates a longitudinal standing wave along the length of the nozzle. The ultrasonic energy originating from the transducers undergoes a step transition and amplification as the standing wave traverses the length of the nozzle. The nozzle is designed such that a nodal plane is located between the transducers. For ultrasonic energy to be effective for atomization, the nozzle tip is preferably located at an anti-node, where the vibration amplitude is greatest. To accomplish this, the nozzle's length is preferably a multiple of a half-wavelength. In general, high frequency nozzles are smaller, create smaller drops, and consequently have smaller maximum flow capacity than nozzles that operate at lower frequencies.

A solution of spray 91' introduced onto the atomizing surface absorbs some of the vibrational energy, setting up wave motion in the liquid on the surface. For the liquid to atomize, the vibrational amplitude of the atomizing surface should be carefully controlled. Below a certain critical amplitude, the energy is insufficient to produce atomized drops. If the amplitude is excessively high, cavitation occurs. The input power is preferably selected to provide an amplitude producing a desired spray having a fine, low velocity mist. Since the atomization mechanism relies only on liquid being introduced onto the atomizing surface, the rate at which liquid is atomized depends solely on the rate at which it is delivered to the surface.

The tubular medical device 50 may be a vascular stent mounted around the mandrel coating assembly 10 described herein. The mandrel coating assembly 10 may be fastened onto the motor 82 that may rotate the mandrel coating assembly at a pre-set speed. In one aspect, the rotational speed is set to 10 rpm. In one embodiment, the coating solution 91 is applied by the ultrasonic spray nozzle of the ultrasonic spray deposition device 92. Optionally, the ultrasonic spray nozzle is translated with respect to the mounted tubular medical device 50 during spray coating, for example at translational speed of about 0.01 mm per second may be maintained between the mounted tubular medical device 50 and the spray nozzle during coating. In another aspect, the rotational speed is set to 60 rpm and the translational speed is set to 0.05 mm per second. In yet another embodiment, the rotational speed is set to 30-150, preferably about 110 rpm, and the translational speed is set to 0.19 mm per second. Other speeds and combinations may also be used in the present invention. Preferred coating parameters for USD using a Sono-tek Model 06-04372 ultrasonic nozzle are provided in Table 1 below:

TABLE 1

Ultrasonic Spray Deposition Parameters for Sono-tek Model 06-04372

| Flow rate (mL/min) | Coating velocity (in/sec) | Rotation Speed (rpm) | Nozzle Power (watts) | Process Gas (psi) | Distance (mm) |
|---|---|---|---|---|---|
| 0.01-2 | 0.01-0.5 | 30-150 | 0.9-1.2 | 0.1-2.5 | 1-25 |

Most preferably, the ultrasonic spray coating is performed at a flow rate of about 0.03 mL/min, a coating velocity of about 0.025 in/sec, a rotation speed of about 60 rpm, a nozzle power of about 1 watt, a process gas pressure of about 2 psi, a distance of about 12 mm between the nozzle 92 and the tubular medical device 50, and a temperature of about 85° F. within a coating chamber. The coating chamber is purged with nitrogen to displace oxygen in the system. During the process, the tubular medical device 50 is kept at ambient temperature and in a closed chamber.

The solution of spray 91' may be loaded into a syringe, which is mounted onto a syringe pump and connected to a tube that carries the solution to the ultrasonic nozzle 92. The syringe pump is then used to purge the air from the solution line and prime the line and spay nozzle 92 with the solution. The tubular medical device 50 is loaded onto a stainless steel mandrel or first member 20 in the ultrasonic coating chamber by the following method. The tubular medical device 50 is held on a first member 20 by the retaining rings 62, 64. Although it is preferable that the gap 62 is present between the tubular medical device 50 and the first member 20, the tubular medical device 50 can touch any part of the first member 20 or mandrel to prevent a webbed coating at the openings 53 between struts and coating at the luminal surface 57 of the tubular medical device 50.

Alternatively, the spray may be applied using a standard pressure spray gun instead of an ultrasonic nozzle. Spray gun coating may be performed with a spray coating solution of the therapeutic agent 95 in a suitable solvent (e.g., paclitaxel in an organic solvent). The surface of the medical device can be bare, surface modified, or a primer coating previously applied to the medical device. The therapeutic agent 95 can be dissolved in a solvent(s) and sprayed onto the medical device under a fume hood using a conventional spray gun, such as a spray gun manufactured by Badger (Model No. 200), or a 780 series spray dispense valve (EFD, East Providence, R.I.). Alignment of the spray gun and stent may be achieved with the use of a laser beam, which may be used as a guide when passing the spray gun over the medical device(s) being coated. For spray gun coating, the therapeutic agent 95 is preferably paclitaxel and the solvent is preferably ethanol. Desirably, a solution of about 0.5-5 mM paclitaxel in ethanol is used. More desirably, a solution of about 1-3 mM paclitaxel in ethanol is used. Even more desirably, a solution of about 2.4-4.7 mM paclitaxel in ethanol is used. Other therapeutic agents and solvents may also be used in the present invention. The distance between the spray nozzle and the nozzle size can be selected for a particular coating application based on various factors, including the area being coated, the desired thickness of the coating and the rate of deposition. Any suitable distance and nozzle size can be selected. For example, for coating an 80 mm long stent, a distance of between about 1-7 inches between the nozzle and stent is preferred, depending on the size of the spray pattern desired. The nozzle diameter can be, for example, between about 0.014-inch to about 0.046-inch. Varying parameters in the spray coating process can result in different solid forms of the taxane therapeutic agent in a deposited coating. Spray coating parameters such as solvent system, fluid pressure (i.e., tank pressure), atomization pressure, ambient temperature and humidity. The solvent is desirably volatile enough to be readily removed from the coating during or after the spray coating process, and is preferably selected from the solvents discussed with respect to the first embodiment for each solid form of a taxane therapeutic agent.

The therapeutic agent 95 in a coating of a medical device of the present invention may be any pharmaceutically acceptable agent such as a non-genetic therapeutic agent, a biomolecule, a small molecule, or cells. The therapeutic agent 95 is preferably selected from the group consisting of an anti-inflammatory agent, an analgesic agent, a local anesthetic agent, a vasospasm-inhibiting agent, a thrombolytic agent, an antithrombogenic agent, an antiproliferative agent, a fibrinolytic agent, a vasodilating agent, an antihypertensive agent, an antimicrobial agent, an antifungal agent, an antisecretory agent, an immunosuppressive agent, a dopamine agonist, a radiotherapeutic agent, a biological agent, an angiotensin converting enzyme (ACE) inhibitor, an antioxidant, a free radical scavenger, and an iron chelator or radiolabelled forms thereof or mixtures of two or more of these. More preferably, the therapeutic agent 95 is an antiproliferative agent. Any of the therapeutic agents may be combined to the extent such combination is biologically compatible.

Exemplary therapeutic agents include anti-thrombogenic agents such heparin, heparin derivatives, prostagiandin (including micellar prostaglandin E1), urokinase, and PPack (dextrophenylalanine proline arginine chloromethylketone); anti-proliferative agents such as enoxaparin, angiopeptin, sirolimus (rapamycin), tacrolimus, everolimus, zotarolimus, monoclonal antibodies capable of blocking smooth muscle cell proliferation, hirudin, and acetylsalicylic acid; anti-inflammatory agents such as dexamethasone, rosiglitazone, prednisolone, corticosterone, budesonide, estrogen, estrodiol, sulfasalazine, acetylsalicylic acid, mycophenolic acid, and mesalamine; anti-neoplasticlanti-proliferative/anti-mitotic agents such as paclitaxel, epothilone, cladribine, 5-fluorouracil, methotrexate, doxorubicin, daunorubicin, cyclosporine, cisplatin, vinblastine, vincristine, epothilones, endostatin, trapidil, halofuginone, and angiostatin; anti-cancer agents such as antisense inhibitors of c-myc oncogene;

anti-microbial agents such as triclosan, cephalosporins, aminoglycosides, nitrofurantoin, silver ions, compounds, or salts; biofilm synthesis inhibitors such as non-steroidal anti-inflammatory agents and chelating agents such as ethylenediaminetetraacetic acid, O,O'-bis (2-aminoethyl)ethyleneglycol-N,N,N',N'-tetraacetic acid and mixtures thereof; antibiotics such as gentamycin, rifampin, minocyclin, and ciprofloxacin; antibodies including chimeric antibodies and antibody fragments; anesthetic agents such as lidocaine, bupivacaine, and ropivacaine; nitric oxide; nitric oxide (NO) donors such as linsidomine, molsidomine, L-arginine, NO-carbohydrate adducts, polymeric or oligomeric NO adducts; anti-coagulants such as D-Phe-Pro-Arg chloromethyl ketone, an RGD peptide-containing compound, heparin, antithrombin compounds, platelet receptor antagonists, anti-thrombin antibodies, anti-platelet receptor antibodies, enoxaparin, hirudin, warfarin sodium, Dicumarol, aspirin, prostaglandin inhibitors, platelet aggregation inhibitors such as cilostazol and tick antiplatelet factors; vascular cell growth promotors such as growth factors, transcriptional activators, and translational promotors; vascular cell growth inhibitors such as growth factor inhibitors, growth factor receptor antagonists, transcriptional repressors, translational repressors, replication inhibitors, inhibitory antibodies, antibodies directed against growth factors, bifunctional molecules consisting of a growth factor and a cytotoxin, bifunctional molecules consisting of an antibody and a cytotoxin; cholesterol-lowering agents; vasodilating agents; agents which interfere with endogenous vascoactive mechanisms; inhibitors of heat shock proteins such as geldanamycin; angiotensin converting enzyme (ACE) inhibitors; beta-blockers; beta-AR kinase (beta-ARK) inhibitors; phospholamban inhibitors; protein-bound particle drugs; and any combinations and prodrugs of the above.

The therapeutic agent 95 may be a biomolecule. Exemplary biomolecules include peptides, polypeptides and proteins; oligionucleotides; nucleic acids such as double or single stranded DNA (including naked and cDNA), RNA, antisense nucleic acids such as antisense DNA and RNA, small interfering RNA (siRNA), and ribozymes; genes; carbohydrates; angiogenic factors including growth factors; cell cycle inhibitors; and anti-restenosis agents. Nucleic acids may be incorporated into delivery systems such as, for example, vectors (including viral vectors), plasmids or liposomes. Other exemplary therapeutic agents are small molecules such as hormones, nucleotides, amino acids, sugars, and lipids and compounds have a molecular weight of less than 100 kD.

The therapeutic agent 95 may be a protein. Non-limiting examples of proteins include serca-2 protein, monocyte chemoattractant proteins (MCP-1) and bone morphogenic proteins ("BMP's"), such as, for example, BMP-2, BMP-3, BMP-4, BMP-5, BMP-6 (VGR-1), BMP-7 (OP-1), BMP-8, BMP-9, BMP-10, BMP-11, BMP-12, BMP-13, BMP-14, BMP-15. Preferred BMP's are any of BMP-2, BMP-3, BMP4, BMP-5, BMP-6, and BMP-7. These BMPs can be provided as homodimers, heterodimers, or combinations thereof, alone or together with other molecules. Alternatively, or in addition, molecules capable of inducing an upstream or downstream effect of a BMP can be provided. Non-limiting examples of angiogenic factors include acidic and basic fibroblast growth factors, vascular endothelial growth factor, epidermal growth factor, transforming growth factors alpha- and beta-, platelet-derived endothelial growth factor, platelet-derived growth factor, tumor necrosis factor alpha, hepatocyte growth factor, and insulin-like growth factor. A non-limiting example of a cell cycle inhibitor is a cathespin D (CD) inhibitor. Non-limiting examples of anti-restenosis agents include p15, p16, p18, p19, p21, p27, p53, p57, Rb, nFkB and E2F decoys, thymidine kinase and combinations thereof and other agents useful for interfering with cell proliferation.

Optionally, the therapeutic agent 95 may include cells such as stem cells, progenitor cells, endothelial cells, adult cardiomyocytes, and smooth muscle cells. Cells can be of human origin (autologous or allogenic) or from an animal source (xenogenic), or genetically engineered. Non-limiting examples of cells include side population (SP) cells, lineage negative ($Lin^-$) cells, mesenchymal stem cells including mesenchymal stem cells with 5-aza, cord blood cells, cardiac or other tissue derived stem cells, whole bone marrow, bone marrow mononuclear cells, endothelial progenitor cells, skeletal myoblasts or satellite cells, muscle derived cells, go cells, endothelial cells, adult cardiomyocytes, fibroblasts, smooth muscle cells, adult cardiac fibroblasts +5-aza, genetically modified cells, tissue engineered grafts, MyoD scar fibroblasts, pacing cells, embryonic stem cell clones, embryonic stem cells, fetal or neonatal cells, immunologically masked cells, and teratoma derived cells.

In one particularly preferred example, the therapeutic agent 95 may be delivered by direct local administration to the vessel site or injury through the plurality of holes in the second balloon. The antisense compound may have: (i) morpholino subunits linked together by phosphorodiamidate linkages, 2 atoms long, joining the morpholino nitrogen of one subunit to the 5' exocyclic carbon of an adjacent subunit; and (ii) a sequence of bases attached to the subunits and containing a therapeutically beneficial antisense nucleotide sequence. While the compound need not necessarily 100% complementary to the target sequence, it is preferably effective to stably and specifically bind to the target sequence such that expression of the target sequence is modulated. The appropriate length of the oligomer to allow stable, effective binding combined with good specificity is about 8 to 40 nucleotide base units, and preferably about 12-25 base units. Mismatches, if present, are less destabilizing toward the end regions of the hybrid duplex than in the middle. Oligomer bases that allow degenerate base pairing with target bases are also contemplated, assuming base-pair specificity with the target is maintained. The compound preferably contains internal 3-base triplet complementary to the AUG site, and bases complementary to one or more bases 5' and 3' to the start site. One preferred compound sequence is the 20mer having the base sequence: 5'-ACG TTG AGG GGC ATC GTC GC-3', where the CAT triplet in the sequences binds to the AUG start site, the 6 bases 3' to the CAT sequence extend in the upstream (5') direction on the target, and the 11 bases 5' to the CAT sequence extend downstream on the target. This compound has enhanced solubility by virtue of having no self-annealing regions. Preferably, the therapeutic agent 95 is a morpholino antisense compound having (i) from 8 to 40 nucleotides, including a targeting base sequence that is complementary to a region that spans the translational start codon of a c-myc mRNA; and (ii) uncharged, phosphorous-containing inter-subunit linkages, in an amount effective to reduce the risk or severity of restenosis in the patient. These therapeutic agents are described in U.S. Pat. No. 7,094,765 and published US patent application US 2006/0269587 A1, which are incorporated herein by reference in their entirety. While the therapeutic agent is described with respect to certain preferred antisense compounds, any suitable therapeutic agent in fluid form (i.e., a gas and/or a liquid) or in a fluid carrier may be delivered from the multi-balloon catheter assembly.

The local delivery of a therapeutic agent 95 from the medical device may mitigate or eliminate vessel recoil and/or neointimal hyperplasia or restenosis upon implantation of the medical device, and may also result in a reduction in inflammation and thrombosis. This local administration of therapeutic agents or compounds to coronary arteries, for example, may also provide a higher tissue concentration of the therapeutic agent(s) compared to systemic administration of the therapeutic agent 95. In addition, reduced systemic toxicity may be achieved utilizing local delivery rather than systemic administration while maintaining higher tissue concentrations. In addition, a single procedure may suffice reduce incidence of patient non-compliance associated with dosing protocols requiring multiple administrations of the therapeutic agent 95 over time. An additional benefit of local administration may be a reduction in the dose of each of the therapeutic agents, while still achieving a desired clinical benefit.

The coating on medical devices may provide for controlled release, which may include long-term or sustained release, of a bioactive material. In one embodiment, the medical device system comprises one or more therapeutic agents dissolved or dispersed in a biologically compatible polymer to form a coating on a medical device from which sustained release of the therapeutic agent 95 occurs, e.g., for at least a few days, and preferably for more than 15, 30, 45 or even 60 days. In preferred embodiments, the sustained release profile of the therapeutic agent(s) is modulated so as to provide sustained release of the pharmaceutical agent over a period of days such as for example, over a period of a few days, and preferably for more than 15, 30, 45 or even 60 days.

Another embodiment provided is a method of applying the coating solution spray 91' that has the therapeutic agent 95 to the tubular medical device 50. The mandrel coating assembly 10, one of many embodiments described herein, and the tubular medical device 50, also described herein, are provided. The tubular medical device 50 can be positioned and fixed around the mandrel coating assembly 10 as described above in relation to the retaining means 60. The coating solution spray 91', including the therapeutic agent 95 and a solvent, can be applied onto the outer surface 55 of the tubular medical device 50 with the coating means 90, as described herein. Preferably the coating means 90 is an ultrasonic spray deposition device 92 positioned radially outside the mandrel coating assembly 10.

The coupling member 70 can also be provided, as well as the means 80 for rotating. The first and second members 20, 30 and the tubular medical device 50 can be rotated about the longitudinal axis 21, while the coating solution spray 91' is being applied. Any coating solution spray 91' that has collected at the openings 53 and the perforations 23 and within the fluid flow channel 31 can be removed with the vacuum means 40.

Components of the mandrel coating assembly 10 can be disassembled or detachable for easy cleaning. After removing the second member 30 from within the first member, the second member 30 and the fluid flow channels 31 can be cleaned. The lumen 28, the outer surface 25 and the perforations 23 of the first member 20 can also be cleaned.

It is therefore intended that the foregoing detailed description be regarded as illustrative rather than limiting, and that it be understood that it is the following claims, including all equivalents, that are intended to define the spirit and scope of this invention.

The invention claimed is:

1. A mandrel coating assembly for applying a therapeutic agent to at least one tubular medical device when loaded onto the assembly, the tubular medical device including an outer surface and a luminal surface and a plurality of openings therethrough, the assembly comprising:

a first member having a proximal end and a distal end and extending along a longitudinal axis, the first member having an outer surface with an outer diameter and a luminal surface defining a substantially cylindrical lumen with a luminal diameter, wherein a portion of the first member has a plurality of perforations between the outer surface and the luminal surface, where the perforations are configured and sized to be in communication with said openings of the at least one tubular medical device when loaded;

a second member having a proximal end and a distal end and extending along the longitudinal axis, at least one portion of the second member being disposed within the first member lumen, the second member having a portion including at least one fluid flow channel in fluid communication with the perforations of the first member, wherein the second member has an outer surface adjacent to the at least one fluid flow channel and where a portion of said outer surface is dimensioned to contact the luminal surface of the first member along substantially an entire length of the second member to define the at least one fluid flow channel; and a vacuum means in fluid communication with the at least one fluid flow channel of the second member, the vacuum means configured to remove excess therapeutic agent when applied.

2. The mandrel coating assembly of claim 1, further comprising a coupling member having a rotating coupling, a connector, and a fluid flow channel connecting the rotating coupling and the connector, said coupling fluid flow channel being in fluid communication with the vacuum means and with the at least one fluid flow channel of the second member.

3. The mandrel coating assembly of claim 2, where the rotating coupling is adapted to attach to at least one of the distal end and the proximal end of the first member, and the connector is attached to the vacuum means.

4. The mandrel coating assembly of claim 1, further comprising a means for rotating the first and second members about the longitudinal axis, the means for rotating being configured to couple to the first and second members.

5. The mandrel coating assembly of claim 1, further comprising a coating means for applying at least one a coating solution including a therapeutic agent and a solvent to said at least one tubular medical device when loaded, the coating means positioned radially outside the first and second members.

6. The mandrel coating assembly of claim 5, where the coating means comprises an ultrasonic spray deposition device, and the ultrasonic spray deposition device is translatable along the longitudinal axis.

7. The mandrel coating assembly of claim 1, where the at least one fluid flow channel has a cross sectional area selected from the group consisting of V-groove, round nose, and dado.

8. The mandrel coating assembly of claim 1, where the at least one fluid flow channel comprises a plurality of fluid flow channels.

9. The mandrel coating assembly of claim 8, where each fluid flow channel is circumferentially spaced substantially equal from the next adjacent fluid flow channel.

10. The mandrel coating assembly of claim 1, where the at least one fluid flow channel is configured to extend helically around the outer surface of the second member.

11. The mandrel coating assembly of claim 1, where the at least one fluid flow channel has a first terminal end disposed near the vacuum means and a second terminal end, the first terminal end being in fluid communication with the vacuum means.

12. The mandrel coating assembly of claim 11, where the vacuum means is a fluid pump that generates a fluid flow from the first terminal end and out of the second terminal end.

13. The mandrel coating assembly of claim 1, where the at least one fluid flow channel has a first region and a second region adjacent thereto, where the first region has a cross-sectional area smaller that a cross-sectional area of the second region.

14. The mandrel coating assembly of claim 1, further comprising a means for retaining said at least one tubular medical device around the first member when loaded, the means for retaining disposed axially adjacent to said at least one tubular medical device.

15. The mandrel coating assembly of claim 14, where the outer diameter of the first member is dimensioned to be spaced to form a gap from said luminal surface of the at least one tubular medical device when loaded.

16. The mandrel coating assembly of claim 1, wherein the portion of the first member having the perforations and the portion of the second member having the at least one fluid flow channel are disposed relative to each other to define a tubular medical device retaining region.

17. The mandrel coating assembly of claim 1, wherein the perforations are disposed along the entire first member and the at least one fluid flow channel is disposed along the entire second member, the second member has a longitudinal length that is substantially the same as a longitudinal length of the first member, and the second member is disposed entirely within the first member lumen.

18. A mandrel coating assembly for applying a therapeutic agent to at least one tubular medical device when loaded onto the assembly, the tubular medical device including an outer surface and a luminal surface and a plurality of openings therethrough, the assembly comprising:

a first member having a proximal end and a distal end and extending along a longitudinal axis, the first member having an outer surface with an outer diameter and a luminal surface defining a substantially cylindrical lumen with a luminal diameter, wherein a portion of the first member has a plurality of perforations between the outer surface and the luminal surface, where the perforations are configured and sized to be in communication with said openings of the at least one tubular medical device when loaded;

a second member having a proximal end and a distal end and extending along the longitudinal axis, at least one portion of the second member being positioned within the first member lumen, the second member having a portion including a plurality of fluid flow channels in fluid communication with the perforations of the first member, wherein the second member has an outer surface adjacent to each of the fluid flow channels where said outer surface is dimensioned to sealably contact the luminal surface of the first member to define the plurality of fluid flow channels such that the contact between said outer surface and the luminal surface is configured to extend substantially an entire length of the tubular medical device, wherein at least one fluid flow channel has a first region and a second region adjacent thereto, where the first region has a cross-sectional area smaller that a cross-sectional area of the second region;

a coating means for applying at least one of a coating solution including a therapeutic agent and a solvent to said at least one tubular medical device when loaded, the coating means positioned radially outside the first and second members; and a vacuum means in fluid communication with the at least one fluid flow channel of the second member, the vacuum means configured to remove excess coating solution when applied.

19. A method of applying a therapeutic agent to at least one tubular medical device, the method comprising:

providing at least one tubular medical device and a mandrel coating assembly, the at least one tubular medical device having an outer surface and a luminal surface defining a lumen, wherein the tubular medical device has a plurality of openings between the outer surface and the luminal surface, the mandrel coating assembly including a first member having an outer surface and a luminal surface defining a lumen, wherein a portion of the first member has a plurality of perforations between the outer surface and the luminal surface, where the perforations are configured and sized to be in communication with said openings of the at least one tubular medical device, a second member having a portion being disposed within the first member lumen, the second member having a portion including at least one fluid flow channel in fluid communication with the perforations of the first member, wherein the second member has an outer surface adjacent to the at least one fluid flow channel and where a portion of said outer surface is dimensioned to contact the luminal surface of the first member along substantially an entire length of the second member to define the at least one fluid flow channel, a coating means for applying at least one of a coating solution and a solvent to said at least one tubular medical device when loaded, the coating means positioned radially outside the first and second members, the coating solution comprising a therapeutic agent, and a vacuum means in fluid communication with the at least one fluid flow channel of the second member, the vacuum means configured to remove excess coating solution when applied;

loading and positioning the at least one tubular medical device around the first member of the mandrel coating assembly;

applying at least one of the coating solution and the solvent with the coating means onto the outer surface of the at least one tubular medical device; and removing said excess coating solution that has collected at the openings of the at least one tubular medical device, the perforations of the first member, and within the at least one fluid flow channel with the vacuum means.

20. The method of applying the therapeutic agent of claim 19, further comprising the step of rotating the first and second members with the loaded at least one tubular medical device with a means for rotating while said applying step is being performed, the means for rotating being configured to couple to the first and second members.

* * * * *

UNITED STATES PATENT AND TRADEMARK OFFICE

CERTIFICATE OF CORRECTION

PATENT NO. : 8,397,666 B2
APPLICATION NO. : 12/328499
DATED : March 19, 2013
INVENTOR(S) : Dennis J. Delap It is certified that error appears in the above-identified patent and that said Letters Patent is hereby corrected as shown below:

In the Claims

In column 20, claim 5, line 42, after “at least one” insert --of--.

In column 21, claim 13, line 7, after “area smaller” replace “that” with --than--.

In column 21, claim 18, about line 60, after “cross-sectional area smaller” replace “that” with --than--.

Signed and Sealed this
Sixth Day of August, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,397,666 B2
APPLICATION NO. : 12/328499
DATED : March 19, 2013
INVENTOR(S) : Delap It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1129 days.

Signed and Sealed this
Twentieth Day of August, 2013

Teresa Stanek Rea
*Acting Director of the United States Patent and Trademark Office*